US008286726B2

(12) United States Patent
Muona et al.

(10) Patent No.: US 8,286,726 B2
(45) Date of Patent: Oct. 16, 2012

(54) USER INTERFACE FOR ROCK DRILLING RIG

(75) Inventors: Jouko Muona, Siuro (FI); Jukka Osara, Hämeenkyrö (FI); Eemeli Haverinen, Tampere (FI); Tommi Säleniemi, Tampere (FI); Timo Kemppainen, Tampere (FI); Ari Junnikkala, Nokia (FI); Isto Virtanen, Lempäälä (FI); Jussi Koskelainen, Tampere (FI); Erkki Eilo, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 188 days.

(21) Appl. No.: 11/991,159

(22) PCT Filed: Aug. 29, 2006

(86) PCT No.: PCT/FI2006/050366

§ 371 (c)(1), (2), (4) Date: May 14, 2008

(87) PCT Pub. No.: WO2007/026051

PCT Pub. Date: Mar. 8, 2007

(65) Prior Publication Data

US 2009/0038847 A1 Feb. 12, 2009

(30) Foreign Application Priority Data

Aug. 30, 2005 (FI) ..... 20055461

(51) Int. Cl.
*E21B 44/02* (2006.01)

(52) U.S. Cl. ..... 175/24; 175/27; 175/40

(58) Field of Classification Search ..... 175/40, 175/27, 24; 173/20, 141
See application file for complete search history.

(56) References Cited

U.S. PATENT DOCUMENTS

| | | | | | |
|---|---|---|---|---|---|
| 4,354,233 | A | * | 10/1982 | Zhukovsky et al. | 702/9 |
| 4,407,017 | A | * | 9/1983 | Zhilikov et al. | 702/9 |
| 4,507,735 | A | | 3/1985 | Moorehead et al. | |
| 4,875,530 | A | | 10/1989 | Frink et al. | |
| 5,240,082 | A | * | 8/1993 | Hayabuchi et al. | 175/24 |
| 5,358,058 | A | * | 10/1994 | Edlund et al. | 175/24 |
| 5,842,149 | A | | 11/1998 | Harrell et al. | |
| 6,021,377 | A | | 2/2000 | Dubinsky et al. | |
| 6,152,245 | A | | 11/2000 | Nilsson | |

(Continued)

FOREIGN PATENT DOCUMENTS

EP 1 193 366 4/2002

(Continued)

OTHER PUBLICATIONS

European search report dated Feb. 8, 2012.

*Primary Examiner* — Kenneth L Thompson
(74) *Attorney, Agent, or Firm* — Morgan, Lewis & Bockius LLP

(57) ABSTRACT

The invention relates to a control apparatus for controlling a rock-drilling rig performing a multiphase rock-drilling event. The control apparatus is arranged to display a working phase indicator on a display, and rock drilling phase-specific information elements is associated with different working phases. The control apparatus is arranged to specify the phase of the rock-drilling event and to update the working phase indicator to display at least one display information element in accordance with the specified working phase.

18 Claims, 4 Drawing Sheets

U.S. PATENT DOCUMENTS

| | | | | |
|---|---|---|---|---|
| 6,152,246 | A | 11/2000 | King et al. | |
| 6,233,498 | B1 | 5/2001 | King et al. | |
| 6,282,452 | B1 | 8/2001 | DeGuzman et al. | |
| 6,389,360 | B1 | 5/2002 | Alft et al. | |
| 6,629,572 | B2 * | 10/2003 | Womer et al. | 175/24 |
| 2002/0060093 | A1 | 5/2002 | Womer et al. | |
| 2004/0182606 | A1 | 9/2004 | Goldman et al. | |
| 2004/0210392 | A1 | 10/2004 | Fleury et al. | |
| 2004/0216922 | A1 * | 11/2004 | Koivunen et al. | 175/24 |

FOREIGN PATENT DOCUMENTS

| | | |
|---|---|---|
| JP | 10-096627 | 4/1998 |
| JP | 10-306676 | 11/1998 |
| JP | 10-311192 | 11/1998 |
| JP | 2003-013686 | 1/2003 |
| JP | 2003-085594 | 3/2003 |
| WO | 01/98631 | 12/2001 |

* cited by examiner

USER INTERFACE FOR ROCK DRILLING RIG

FIELD OF THE INVENTION

The invention relates to an arrangement of a user interface for a rock drilling rig and for a control system thereof.

BACKGROUND OF THE INVENTION

A rock drilling event comprises a plurality of steps, such as moving feed beam against rock, collaring, full power drilling, and finishing. These steps are very different and a large amount of different information is presented to the operator by means of several meters. Management of the incoming information flow is not easy for the operator monitoring and controlling the drilling event. A rock drilling rig may comprise a plurality of booms capable of simultaneous drilling, i.e. several drilling events may be in progress. Even if the drilling could be coupled to automatic control, the operator still has to be able to monitor the progress of a plurality of different drilling events, if need be. In accordance with a known solution, an active working phase can be indicated for switching on a led light in a control panel, i.e. a led light associated with the active working phase is turned on from a led light beam.

BRIEF DESCRIPTION OF THE INVENTION

The object of the present invention is to provide a new and improved user interface for rock drilling rigs. The object of the invention is achieved with a control apparatus, a rock drilling rig and a computer program product, which are characterized in what is stated in the independent claims. Some preferred embodiments are described in the dependent claims.

In accordance with an aspect of the invention, the control unit that controls the information displayed on the display of the control apparatus of the rock drilling rig is arranged to display a working phase indicator on the display, and rock drilling phase-specific display information elements are associated with the different working phases of a rock drilling event. The control apparatus is arranged to specify the phase of the rock drilling event and to update the working phase indicator so as to display at least one display information element in accordance with the working phase specified. Generally, a display information element refers to an indication to be displayed to an operator in any form for indicating the working phase of the rock drilling event.

In accordance with an embodiment, the control unit is arranged to display the working phase indicator, wherein space is reserved for indicating the current working phase, the previous working phase and/or the following working phase. Typically, a drilling event includes a given working cycle, i.e. the working phases are advanced in order, allowing the following working phase in the drilling event to be displayed to the operator.

In accordance with another embodiment, the input device of the control apparatus is arranged to receive an input from a user regarding a change of working phase. The control apparatus is arranged to update the display information elements displayed in the working phase indicator in response to an input received from the input device and indicating a change of working phase.

The operator of the drilling apparatus may be offered an improved solution for managing drilling cycles. The operator may be shown, on the display, information on the state of the drilling event (typically a working cycle) what is to be updated on the basis of the changes. Such an updateable working phase indicator improves usability, since the operator is able to easily and fast get an impression from the working phase indicator about the current phase of the drilling event, when otherwise monitoring the display. This is particularly usable for inexperienced operators and in situations wherein there is need to monitor and/or control a plurality of simultaneous drilling events, for example when drilling with a plurality of drilling booms. State information may be displayed consistently at the same position on the display.

BRIEF DESCRIPTION OF THE FIGURES

Some embodiments of the invention will be described in more detail in the accompanying drawings, in which FIG. 1 schematically shows a rock drilling rig.

In the figures, some embodiments of the invention are displayed in a simplified manner for the sake of clarity. In the figures, like parts are denoted with the same reference numerals.

DETAILED DESCRIPTION OF SOME EMBODIMENTS OF THE INVENTION

Figure 1:
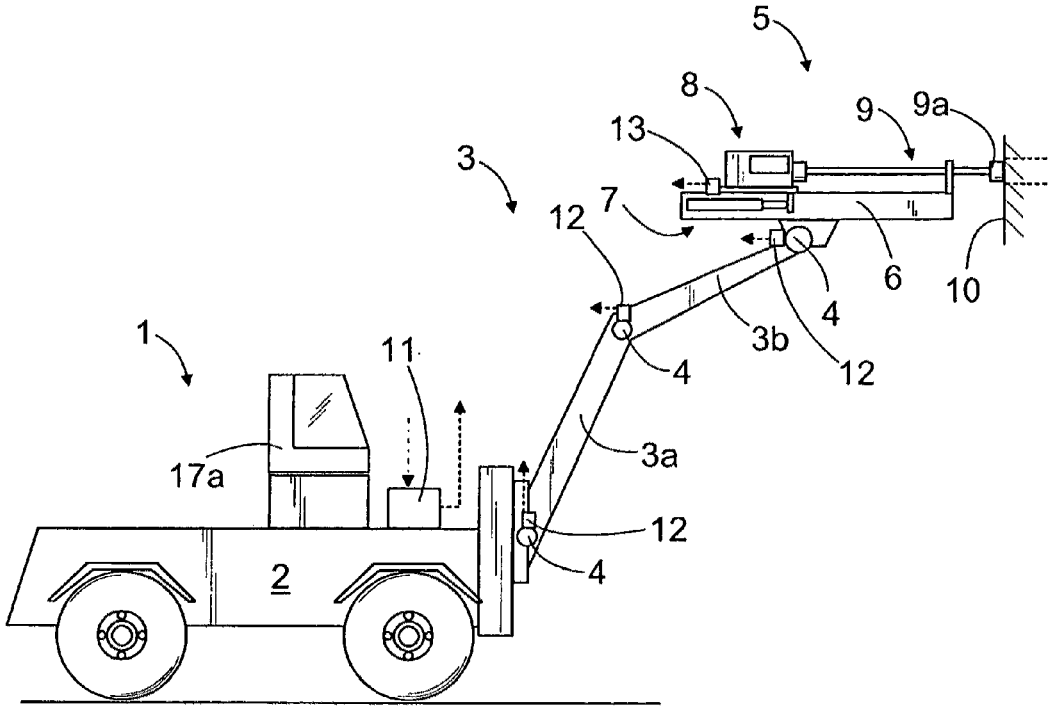

FIG. 1 illustrates a rock drilling rig. It is to be noted that applying the invention is not restricted to any specific rock drilling rig. The invention may also be applied to remote-controlled rock drilling rigs, wherein part of the control means of the rock drilling rig is placed in a separate monitoring room, above ground, for example. This being so, at least part of the characteristics of the invention may thus be implemented in connection with a user interface external to the rock drilling rig.

The rock drilling rig 1 shown in FIG. 1 may comprise a movable carrier 2, in which one or more drilling booms 3 are arranged. The drilling boom 3 may be composed of one or more boom parts 3*a*, 3*b*, which may be connected with each other and with the carrier 2 with joints 4 in a manner allowing the booms 3 to be moved versatilely in different directions. Furthermore, the free end of each drilling boom 3 may comprise a drilling unit 5, which may comprise a feed beam 6, a feeding device 7, a rock drill section 8 and a tool 9, whose outermost end comprises a drill bit 9*a*. The rock drill 8 is movable by means of the feeding device 7 relative to the feed beam 6 in a manner allowing the tool 9 to be fed during drilling towards a rock 10. The rock drill 8 may comprise an impact device for supplying shock pulses to the tool 9, and further a rotating device for rotating the tool 9 around its longitudinal axis. The rock drilling rig 1 comprises a drilling control system 11 for controlling the drilling. The drilling control system 11 may give commands to actuators moving the drilling boom 3 and to other actuators affecting the execution of the drilling event. Furthermore, one or more sensors 12 may be arranged in connection with the joints 4 of the drilling boom 3, and one or more sensors 13 may be arranged in connection with the drilling unit 5. The measurement data obtained from the sensors 12, 13 may be conveyed to the control apparatus 11, which can use the measurement data to determine the position and direction of the drilling unit 5 for controlling purposes. The drilling control system 11 may be adapted to consider the position of the drilling unit 5 as the position of the drill bit 9*a* and the direction of the longitudinal axis of the tool 9. It is to be noted that the drilling control system 11 may be composed of a plurality of subsystems and comprise a plurality of control units, as will be illustrated in the following examples.

Figure 2A:
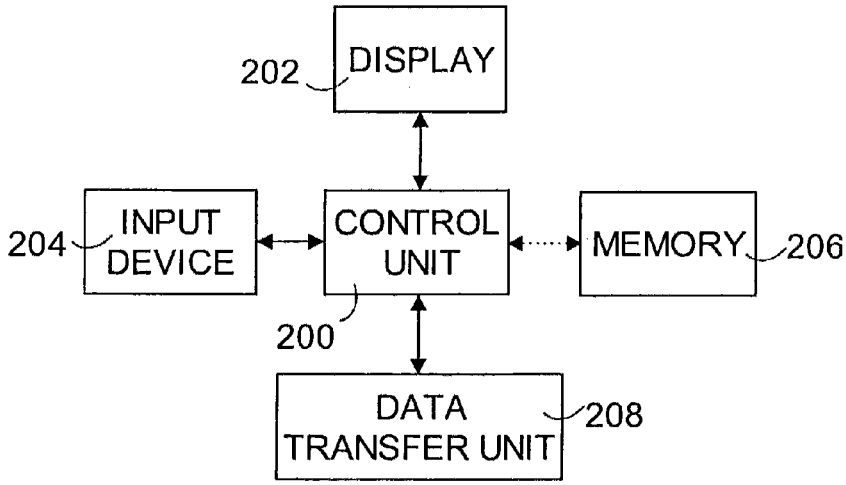
FIGS. 2*a* and 2*b* illustrate some operational units of a control system for a rock drilling rig.

FIG. 2*a* illustrates some operational units of the control apparatus of a rock drilling rig 1, wherein the operational units may be located in the rock drilling rig 1 or in a possible separate monitoring room. A control unit 200 may be part of the general drilling control system 11 of FIG. 1 or in a separate user interface control system and it attends to at least the control of a display 202. Thus, the control unit 200 controls the operations of at least some other operational units of the rock drilling rig 1 and is part of the control system of the rock drilling rig 1. The user interface of the rock drilling rig 1 comprises an input device 204 and a display 202. In addition, the user interface may comprise other parts, such as a loudspeaker. The input device 204 may be any device or a combination of devices, such as a mouse, a spherical controller, a touch screen and/or a joystick that receives inputs from a user. The device of FIG. 2*a* also comprises a data transfer unit 208, which attends to data transfer between the control unit and at least one external data transfer unit. The data transfer unit 208 may attend to the reception of measurement data from sensors 12, 13 and to the transmission of control data to the drilling unit 5, for example. The internal control of the device may utilize some suitable bus technique. The rock drilling rig 1 may also communicate wirelessly, in which case the apparatus 1 comprises a wireless transceiver. The apparatus 1 also comprises memory 206, in which computer program code for controlling the control unit 200 and/or different settings and data employed for controlling the rock drilling rig 1 may be stored, for example.

Computer program codes executed in the processing unit of the rock drilling rig 1 or the external monitoring room may cause the control system to make the control unit 200 implement actions associated particularly with the control of a multi-phase rock drilling event, some embodiments thereof being illustrated below in connection with FIGS. 2*b*, 3*a*, 3*b*, 4, 5*a* and 5*b*. It is also possible to use a hardware solution or a combination of software and hardware solutions for implementing the inventive functions. Information and computer program code affecting the operation of the rock drilling rig 1 may be stored with a separate memory means and possibly transferred via a network to the memory 206 for implementing the operations of the control unit 200.

FIG. 2*a* shows a control unit 200 that controls the operation of the user interface and controls at least the display 202. The control unit 200 may be arranged to execute also other control functions. It is to be noted that the rock drilling rig 1 may comprise a plurality of control units for different purposes.

Figure 2B:
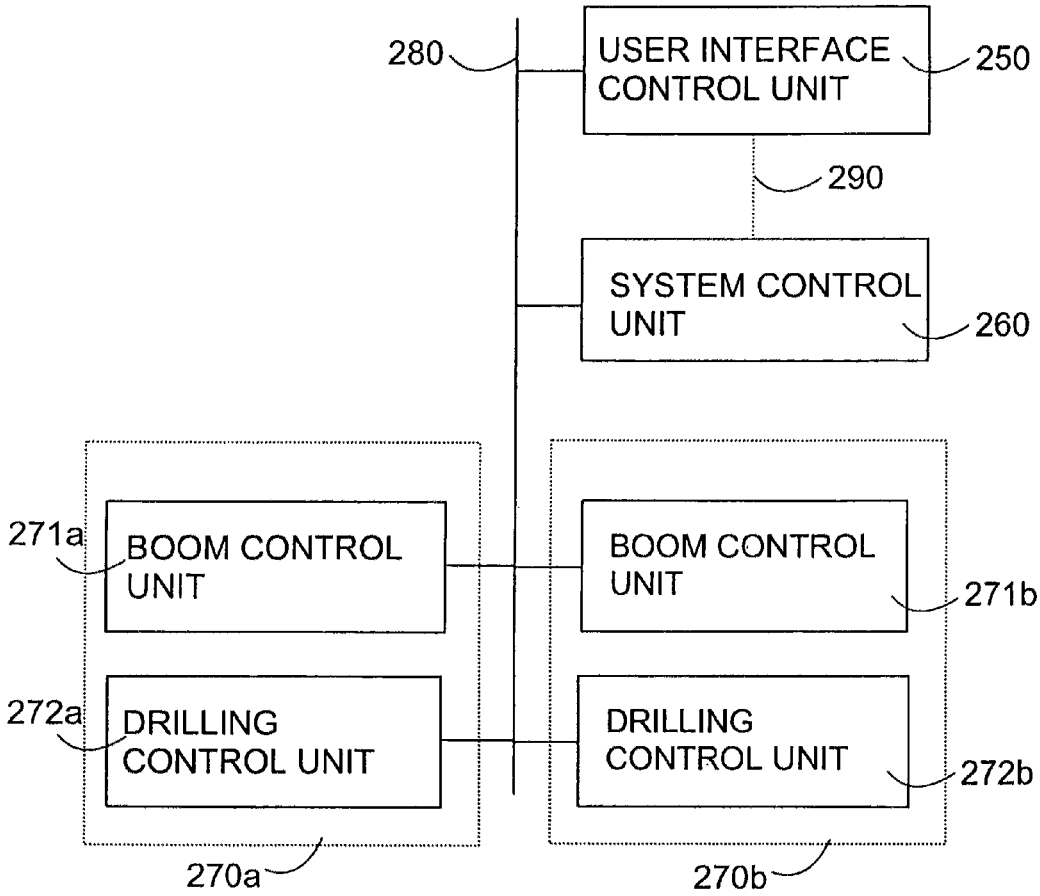

FIG. 2*b* illustrates a control system configuration of the rock drilling rig 1 that may constitute the drilling control system 11 illustrated in FIG. 1. The control system of the rock drilling rig 1 may comprise a plurality of subsystems 270*a*, 270*b* having separate control units. In the control system example of FIG. 2*b*, a separate drilling unit-specific control process or control aggregate 270*a*, 270*b* is arranged for each boom or other type of drilling unit, possibly in such a manner that each boom or other type of drilling unit is controlled and monitored by a separate data processing device. In the system of FIG. 2*b*, the different control units may be implemented with separate data processing devices. Each drilling unit-specific control process 270*a*, 270*b* may comprise a boom control unit 271*a*, 271*b* particularly for controlling the movement of the drilling unit, and a drilling control unit 272*a*, 272*b* for controlling the drilling performed with said drilling unit. These control units 271*a*, 271*b*, 272*a*, 272*b* are further connected to appropriate sensors and/or valves (not shown in FIG. 2*b*). For system management there is a separate system control unit 260. A user interface control unit 250 controls the user interface and receives operator inputs from input devices (not shown in FIG. 2*b*). The user interface control unit 250 may be the control unit 200, illustrated in connection with FIG. 2*a* and hereinafter, to which operator input devices 204 and a display 202 are connected.

Information specified by the separate control aggregate and/or process 270*a*, 270*b* is transferred to the user interface control unit 250 that is arranged to display data received from these different units on the display 202. In particular, a working phase state machine for a drilling event executable in said drilling unit may be maintained in the drilling unit-specific process 270*a*, 270*b*, i.e. the working cycle may be specified on the basis of predetermined working cycle specifications and/or commands received from a user. The process 270*a*, 270*b* specifies working phase state information that is transmitted to the user interface control unit 250. By utilizing functions to be described later, the control unit 250 is able to use the received state information to maintain a working cycle indicator on the display 202. Correspondingly, separate control units may be controlled from one input device 204, in which case the control unit 250 transfers control commands to a suitable control aggregate 270*a*, 270*b*, for instance to the control device 271*a*, 271*b* of the boom currently controlled by the user. In this case, the functions associated with the input device 204 (and the control unit) may vary on the basis of the operating situation and/or the object to be controlled. Information is maintained in the user interface control device 250 about the object to be currently controlled and about the functions selectable with the input device 204 and at least about the control units to which an input supplied to the input device 204 is to be relayed. Alternatively, different input devices 204 are employed for managing the different objects and/or other control units are connected to the input device 204.

The control units 250, 260, 271*a*, 271*b*, 272*a*, 272*b* are connected to a data transfer bus 280, for instance to a bus based on the CAN bus technique (Controller Area Network). FIG. 2*b* also illustrates with a broken line 290 a second data transfer interface between the system control unit 260 and the user interface control unit 250, which may be based on Ethernet data transfer, for example.

However, a more detailed description of these control units 260, 271*a*, 271*b*, 272*a*, 272*b* is not required for understanding the invention. The control system, for instance the system control unit 260, may include a subsystem for data collection and reporting and a separate reporting program may be employed for displaying report data to the operator. In the following, the operation of the control system will be illustrated in more detail with reference to FIG. 2*a*. The control system illustrated above may be located in the rock drilling rig 1 (control apparatus 11). Alternatively, at least part of the control apparatus is located separately from the rock drilling rig 1. For example, the display 202, one or more control units 200 and user interface means for controlling the rock drilling rig 1 may be implemented in a monitoring room located above ground.

The control unit 200 that controls the display 202 is arranged to display the working phase indicator on the display 202, and rock drilling phase-specific display information elements are associated with the different working phases of a rock drilling event. The indicator indicating the working phases may also be called a working (phase) cycle indicator or a working state indicator. The control unit 200 is arranged to update the at least one display information element displayed in the working phase indicator in accordance with the current working phase. The display information element may be stored in the memory 206 and it may be text, an image or a combination thereof, for example. Binding information that associates rock drilling phases (indicators) and display information elements with each other may be stored in the memory 206. In connection with a change of working phase, the control unit 200 may retrieve the display information element associated with the working phase from the memory 206 on the basis of the binding information and the working state information or an indicator, and control it to be displayed in the working phase indicator. The working phase may be known to the control unit 200, e.g. stored in the memory 206, in response to a user input or a change of automatic working cycle. Alternatively, if the management of a drilling event is implemented in a different unit, the control unit 200 may receive information from said different unit automatically or in response to a prompt.

Figure 3:
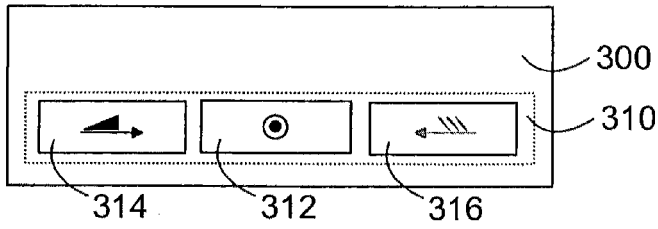
FIG. 3 shows a working phase indicator according to an embodiment.

FIG. 3 illustrates a working phase indicator 300 according to an embodiment. The working phase indicator 300 comprises an updateable area 310 for indicating the current working phase 312, the previous working phase 314 and the following working phase 316. In this space 310, rock drilling phase-specific display information elements 312, 314, 316 are shown. FIG. 3 illustrates the use of icons, but implementing the invention is not restricted to any special information type. A plurality of other ways of presentation may also be used. The display information elements 312, 314, 316 may also be emphasized in different manners, such as by the use of different colours, different contrasts, blinking an information element, etc.

In accordance with an embodiment, supplementary information about one or more indicated working phases is displayed in the working phase indicator 300. Some examples are presented in the following. Supplementary information about the current working phase may be displayed in the space 312 or outside thereof. For example, supplementary text information about the state of the working phase is displayed above the information element 312. A given working phase may have sub-phases, e.g. 'start', 'full power' and 'stop', which are displayed as supplementary information Other elements on the display 202 may also be updated on the basis of the working phase. For example, measurement information received from the drilling device 5 may be displayed on the display 202, possibly also in the working phase indicator 300. Naturally, information about the current working phase has to be displayed on the display 202, the drilling plan, for example. Supplementary information may also be provided by different manners of emphasizing.

In accordance with an embodiment, the working phase indicator 300 is part of the display 202 and the control unit 200 is arranged to display it in the different views of the display 202 in a fixed position in a manner allowing the user to always obtain information about at least the current rock drilling phase in the same position.

A rock drilling event includes a plurality of phases, and the working phase indicator 300 may be used to illustrate the working phase cycle to the user better than previously. For example, at lest some of the following phases may be separated from a rock drilling event: boom positioning, moving feed beam against rock, collaring, acceleration ramp, full power drilling, finishing, reverse drifter and reversing feed beam from rock. Accordingly, a hole to be drilled is subjected to these phases, after which the working cycle may again transfer to boom positioning for the following hole. Transfer from one working phase to another is carried out in response to a decision to change working phases by the control process (e.g. process 270*a*, 270*b* in FIG. 2*b*) and/or an input by the operator. For example, part of the working cycle may be carried out automatically, whereas the transfer to a given working phase requires an input by the operator. The working phases have special display information elements, which are updated at points descriptive of the current phase 312, the previous phase 314 and the following phase 316 of the working phase indicator 300 of FIG. 3, for example. However, it should be noted that the working phases shown in the working phase indicator are not limited to these, but any drilling event working phase cycle can be indicated with appropriate detailing.

Typically, one drilling unit, such as a boom or a bar, performs one sequential working cycle, but the working cycle may include a phase from which a new working cycle is initiated as a sub-process. The new working cycle may be an auxiliary function, such as a sequence of working phases relating to bar processing, and it is optionally implemented as the original working cycle continues. The new working phase may also have to be initiated because of a state of emergency, for instance when a drill bit is stuck. In accordance with an embodiment, the control unit 200 is arranged to update the working phase indicator 300 or to display a new working phase indicator 300 for a sub-process on the display 202. The control unit 200 may be arranged to specify a plurality of areas 310 in the working phase indicator 300 for the different working cycles of the same drilling unit. In accordance with an embodiment, the control unit 200 is arranged to indicate special situations in the working phase indicator 300.

In accordance with an embodiment, the control unit 200 that controls the display 202 is arranged to check if the working phase is inhibited in the current situation of the rock drilling event. This check may be implemented for instance on the basis of settings stored in advance in the memory 206 in response to a change of working phase or to a need to change working phases. The control unit 200 is arranged to display the inhibited working phase with a display information element different from an allowed working phase. The control unit 200 (or another control unit, such as a possible separate control unit that controls the drilling process) is arranged to inhibit the change of rock drilling phase to the inhibited working phase. Thus, a transfer to an inhibited working phase selected by the user may be prevented or a transfer to the inhibited working phase may be prevented by preventing user selections with the input device 204.

In accordance with an embodiment, the rock drilling rig 1 includes different operating modes, in accordance with which transfer between the different working states is arranged. As was mentioned, the rock drilling rig 1 may have a manual control mode, whereby working states are changed in response to user input, or an automatic control mode, whereby working states may be changed without user input at the end of the previous working phase. Other more detailed operating modes may also be used. For example, the apparatus 1 may include a selectable stepwise (STEP) mode, wherein the working cycle always ends after each working phase. Another exemplary mode is a hole drilling mode (HOLE), wherein the working cycle ends after the drilling of one hole. The working cycle may also be continuous (CONT), in which case the boom is positioned according to planned sequences, i.e. the working cycle is performed for specified drilling objects. In this automatic mode (CONT), too, the operator may, when desired, manually control the functions of the apparatus 1, and changes working phases with the input device 204, for example. The working phase indicator 300 may indicate the operating mode and/or display the display information elements in accordance with the operating mode. The control unit 200 may be arranged to set one or more working states as inhibited in the above-mentioned manner on the basis of the current operating mode. The user interface also provides an option to change operating modes.

Figure 4:
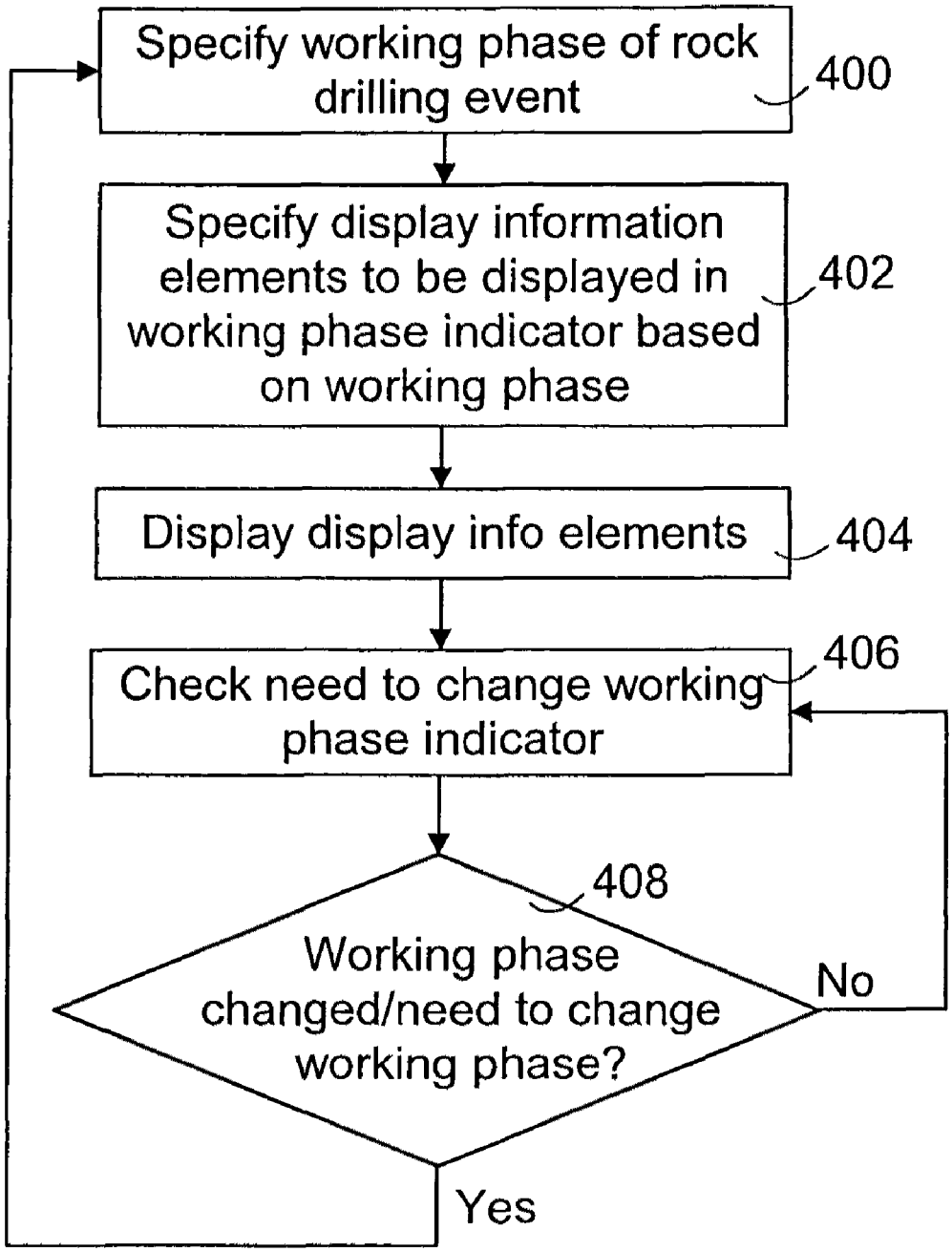
FIG. 4 illustrates a method according to an embodiment.

FIG. 4 illustrates a basic process relating to the working phase indicator 300 in accordance with an embodiment, implementable in the control unit 200. In step 400, the working phase of the rock drilling event is specified, on the basis of which the display information elements to be displayed in the working phase indicator 300 are specified 402; elements 312, 314 and 316 in the example of FIG. 3. The specification of the working phase in step 400 may be arranged, depending on the implementation, during a change of working phase or on the basis of information indicative of a change of working phase. For example, when the control system of FIG. 2*b* is applied, the control unit 250 may specify the working phase on the basis of state information received from the boom-specific control process 270*a*, 270*b*. In accordance with an embodiment, the information element, e.g. an icon, to be displayed on the device 202, may be specified on the basis of the binding information and working phase state information stored in the memory 206 or a working phase identifier from the memory 206.

In step 404, the specified display information elements are displayed. Typically in a rock drilling event, a transfer either to the following or to the previous working phase takes place one step at a time allowing the working phases to be 'scrolled' in step 400. In step 406, a check is made as to whether there is need to update the working phase indicator 300. The control unit 200, 250 may carry out step 406 on the basis of information or a command received from another system part, for example on the basis of state information or other information received from the second control process 270*a*, 270*b* of FIG. 2*b*. This step may be arranged as part of a general screen update or possibly in response to an input (not shown in FIG. 4) received in the control unit 200, for example an input received from the input device 204. If the check 406, 408 indicates that the working phase has changed, then it is necessary to update the working phase indicator 300, and the process continues to step 400. If the changed working phase (and any other working phases to be displayed in the working phase cycle element) is already known, step 402 can be directly entered. Alternatively, step 406 is re-entered.

FIG. 4 is simplified; it does not show the start or end of the process or supplementary embodiments, but other steps may also be added to this basic process on the basis of the description. For example, separate check steps may exists for user inputs achieving or indicating a change of working phase and information received from the system control process 270*a*, 270*b*. It should also be noted that it is not necessary to carry out the separate check step 406 in the process, instead, information is received in the process about a change of working phase, after which step 400 may be entered.

Figure 5A:
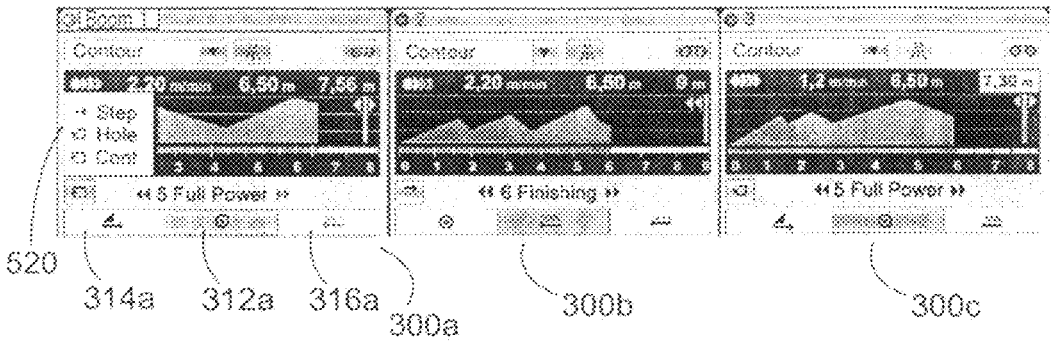
FIGS. 5*a* and 5*b* show some exemplary user interfaces.
Figure 5B:
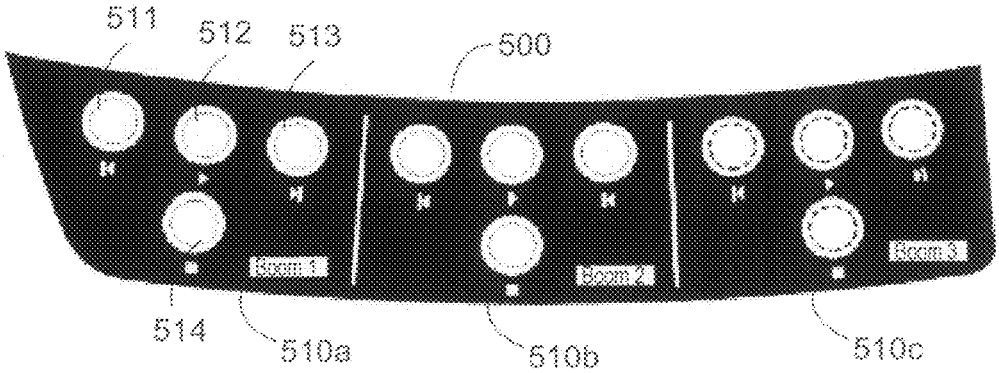

FIGS. 5*a* and 5*b* illustrate some user interface parts for a rock drilling rig 1. FIG. 5*a* illustrates a view in the display 202, with boom-specific working phase indicators 300*a*, 300*b* and 300*c* separately for three booms descriptive of their working situation. The system working cycle is indicated to all booms. As is denoted for boom 1, the system shows a current working phase 312*a*, a previous working phase 314*a* and a following working phase 316*a* of the working cycle. An information element 316*a*, indicative of the following working phase, may indicate the working phase into which the system is transferred next during an automatic working cycle mode. If the user is able to determine the transfer to the following working phase, the information element 316*a* may be shown emphasized. In the example of FIG. 5*a*, the information element 316*a* is shown different (grey) from allowed transfers. The information element 314*a* indicating the previous working phase may indicate the previous working phase during the automatic working cycle mode. If the user is able to determine the transfer to the previous working phase, the information element 314*a* may be displayed emphasized. The section of boom 1 also shows a menu 520 enabling a change of operating mode. The operating mode is indicated in the working phase indicator 300*a*, 300*b*, 300*c*, with an icon located at the left edge, i.e. the operating mode of boom 1 is automatic (CONT). Other boom-specific information may also be displayed to the operator; FIG. 5*a* illustrates some different information sources, information relating to which can be received by the control unit 200 and controlled to be displayed on the display 202.

FIG. 5*b* shows a control panel part 500 serving as the input device 204 that the control unit 200 can use for receiving inputs from the user and for controlling, on the basis of the inputs, the working phase indicators 300*a*, 300*b*, 300*c*. For example, the control panel 500 may be located in an armrest of the rock drilling rig 1. For each boom, the control panel 500 comprises a special control aggregate 510*a*, 510*b* and 510*c*. Each control aggregate has three buttons with related working cycle control operations 'previous' (working phase) 511, 'following' 513, 'start-up' 512, and 'stop' 514 indicated with icons denoted below the buttons. When the user interface according to FIGS. 5*a* and 5*b* is applied, the user may for instance control the boom 1 with the control aggregate 510*a*, the working state of the boom being shown in the working phase indicator 300*a*. Accordingly, when the user chooses to press the button 'following' 513 of the control aggregate 510*a*, for example, the working cycle of boom 1 is controlled to transfer to the following working phase (provided this is allowed). On the basis of this input, each information element in the working phase indicator 300*a* is updated. For example, field 312*a* may indicate, dimmed, a phase that is activated when start button 512 is pressed and the active phase (when automatic working cycle mode is active) emphasized.

In accordance with an embodiment, the working situation and/or a change therein is also indicated in one or more input devices 204. In this case, a small display or another means for displaying said information may be arranged in connection with the input device 204, for example. In connection with the update of the working phase indicator 300 illustrated above, the control unit 200 is also able to update the data indicated in the input device. At its simplest this can be arranged for instance by means of lights in the input device 204. For example, a signal light controlled by the control unit 200 on the basis of the working phase may be arranged in the keys 511 to 514 of the control panel 500 illustrated in FIG. 5*b* or in connection therewith.

In some cases, the characteristics disclosed in the present application may be used as such, irrespective of the other characteristics. On the other hand, the characteristics disclosed in the present application may be combined for generating different combinations, if need be. The drawings and the related description are only intended to illustrate the idea of the invention. The details of the invention may vary within the scope of the claims.

The invention claimed is:

1. A control apparatus for controlling a rock drilling rig performing a multi-phase rock drilling event comprising three or more different rock drilling phases, the control apparatus comprising:

a display;

an input device for receiving user inputs; and at least one control unit that controls information to be displayed on the display, wherein the control unit is configured to display a working phase indicator on the display, and that one or more rock drilling phase-specific display information elements are associated with at least some of the different rock-drilling phases of the rock drilling event in binding information stored in a memory of the control apparatus, wherein the control apparatus is configured to specify one of the different rock drilling phases of the rock drilling event, wherein the control unit is configured to update the working phase indicator to display at least one display information element that is automatically specified on the basis of information indicative of the rock drilling phase and the binding information, wherein the control unit is configured to display a plurality of information elements in the working phase indicator, at least two information elements at a time, each of the information elements indicating a different working phase, the working phase indicator being adapted to indicate at least two of a present working phase, a previous working phase, or a following working phase, and wherein each one of the present working phase, the previous working phase, and the following working phase is one of the three or more different rock drilling phases.

2. The control apparatus as claimed in claim 1, wherein:

the input device is configured to receive an input from a user for changing working phases; and the control apparatus is configured to update the display information elements to be displayed in the working phase indicator in response to an input received from the input device and indicating a change of working phase.

3. The control apparatus as claimed in claim 1, wherein:

the control apparatus is configured to check if the rock drilling phase is inhibited in a current situation of the rock drilling event; and the control unit is configured to display an inhibited working phase using a display information element deviating from an allowed working phase.

4. The control apparatus as claimed in claim 1, wherein:

the control apparatus is configured to prevent a change of rock drilling phase to an inhibited working phase in response to an input received from a user implying a transfer to the inhibited working phase; or the control apparatus is configured to prevent user selections for the transfer to the inhibited working phase.

5. The control apparatus as claimed in claim 1, wherein:

different selectable operating modes are set in the control apparatus, according to which a transfer between different working states is specified; and the control unit is configured to update the display information elements to be displayed in the working phase indicator in accordance with an operating mode in use.

6. The control apparatus as claimed in claim 1, wherein:

the input device comprises drilling unit-specific input device sections for drilling unit-specifically controlling each drilling unit of a drilling apparatus; and the control unit is configured to display a special working phase indicator for each drilling unit on the display and to update the working phase indicator on the basis of an input relating to the working phase indicator and detected in the input device section.

7. The control apparatus as claimed in claim 1, wherein:

the control unit is configured to specify the information element to be displayed in the working phase indicator on the basis of the binding information and state information indicative of a current working phase or an identifier; and the control unit is configured to display at least one display information element specified on the basis of the binding information and the state information indicative of the current working phase or the identifier.

8. The control apparatus as claimed in claim 1, further comprising:

at least one drilling management unit configured to maintain a state machine about a rock drilling event, wherein the drilling management unit is configured to transmit the state information to the control unit controlling the display for indicating at least a current working phase, and wherein the control unit is configured to specify the at least one display information element to be displayed in the working phase indicator on the basis of the state information received from the drilling management unit.

9. A rock drilling rig, comprising:

a drilling unit for performing a multi-phase rock drilling event comprising three or more different rock drilling phases; and a control apparatus, the control apparatus including:

a display; and at least one control unit that controls information to be displayed on the display, wherein the control unit is configured to display a working phase indicator on the display, and that one or more rock drilling phase-specific display information elements are associated with at least some of the different rock-drilling phases of the rock drilling event in binding information stored in a memory of the control apparatus, wherein the control unit is configured to specify one of the different rock drilling phases of the rock drilling event, wherein the control unit is configured to update the working phase indicator to display at least one display information element that is automatically specified on the basis of information indicative of the rock drilling phase and the binding information, wherein the control unit is configured to display a plurality of information elements in the working phase indicator, at least two information elements at a time, each of the information elements indicating a different working phase, the working phase indicator being adapted to indicate at least two of a present working phase, a previous working phase, or a following working phase, and wherein each one of the present working phase, the previous working phase, and the following working phase is one of the three or more different rock drilling phases.

10. The rock drilling rig as claimed in claim 9, wherein:

the control apparatus is configured to check if the rock drilling phase is inhibited in a current situation of the rock drilling event; and the control unit is configured to display an inhibited working phase using a display information element deviating from an allowed working phase.

11. The rock drilling rig as claimed in claim 9, wherein:

the control apparatus is configured to prevent a change of rock drilling phase to an inhibited working phase in response to an input received from a user implying a transfer to the inhibited working phase; or the control apparatus is configured to prevent user selections for the transfer to the inhibited working phase.

12. The rock drilling rig as claimed in claim 9, wherein:

different selectable operating modes are set in the control apparatus, according to which a transfer between different working states is specified; and the control unit is configured to update the display information elements to be displayed in the working phase indicator in accordance with an operating mode in use.

13. The rock drilling rig as claimed in claim 9, wherein:

a user input device of the rock drilling rig comprises drilling unit-specific input device sections for drilling unit-specifically controlling each drilling unit of a drilling apparatus; and the control unit is configured to display a special working phase indicator for each drilling unit on the display and to update the working phase indicator on the basis of an input relating to the working phase indicator and detected in the input device section.

14. The rock drilling rig as claimed in claim 9, wherein:

the control unit is configured to specify the information element to be displayed in the working phase indicator on the basis of the binding information and state information indicative of a current working phase or an identifier; and the control unit is configured to display at least one display information element specified on the basis of the binding information and the state information indicative of the current working phase or the identifier.

15. The rock drilling rig as claimed in claim 9, wherein the control apparatus further comprises at least one drilling management unit configured to maintain a state machine about a rock drilling event, wherein:

the drilling management unit is configured to transmit the state information to the control unit controlling the display for indicating at least a current working phase; and the control unit is configured to specify the at least one display information element to be displayed in the working phase indicator on the basis of the state information received from the drilling management unit.

16. A memory medium embodying a computer program product for controlling at least one data processing device of a rock drilling rig, the computer program product comprising computer program code for controlling, when executed in a processor of the data processing device, a control system to:

display a working phase indicator comprising at least one rock drilling phase-specific display information element associated with a working phase of a rock drilling event comprising three or more different rock drilling phases, on a display;

specify one of the three or more different rock drilling phases of the rock drilling event;

update the working phase indicator to display at least one display element that is automatically specified on the basis of information indicative of the rock drilling phase and binding information stored in a memory; and display a plurality of information elements in the working phase indicator, at least two information elements at a time, each of the information elements indicating a different working phase, the working phase indicator being adapted to indicate at least two of a present working phase, a previous working phase, or a following working phase, wherein each one of the present working phase, the previous working phase, and the following working phase is one of the three or more different rock drilling phases.

17. The memory medium as claimed in claim 16, wherein:

the computer program product comprises computer program code for controlling the control system to receive an input about a change of working phase from a user; and computer program code for controlling the control system to update the display information elements to be displayed in the working phase indicator in response to an input received from an input device and indicating a change of working phase.

18. The memory medium as claimed in claim 16, wherein the computer program product comprises:

computer program code for controlling the control system to specify the information element to be displayed in the working phase indicator on the basis of the binding information and state information indicative of the current working phase; and computer program code for controlling the control system to display the at least one specified display information element on the display on the basis of the binding information and the state information indicative of a current working phase.

* * * * *